US012667235B2

(12) United States Patent
Bennett et al.

(10) Patent No.: US 12,667,235 B2
(45) Date of Patent: Jun. 30, 2026

(54) CLEANER HEAD FOR A CLEANING APPLIANCE

(71) Applicant: Techtronic Cordless GP, Anderson, SC (US)

(72) Inventors: Samuel Bennett, Downend Bristol (GB); Peter Davies, London Greater London (GB); Tobias Hale, Gretton Gloucestershire (GB)

(73) Assignee: Techtronic Floor Care Technology Limited, Tortola (VG)

( * ) Notice: Subject to any disclaimer, the term of this patent is extended or adjusted under 35 U.S.C. 154(b) by 853 days.

(21) Appl. No.: 17/787,500

(22) PCT Filed: Dec. 18, 2020

(86) PCT No.: PCT/GB2020/053308
§ 371 (c)(1),
(2) Date: Jun. 20, 2022

(87) PCT Pub. No.: WO2021/123826
PCT Pub. Date: Jun. 24, 2021

(65) Prior Publication Data

US 2023/0016051 A1 Jan. 19, 2023

(30) Foreign Application Priority Data

Dec. 20, 2019 (GB) ..... 1918988

(51) Int. Cl.
*A47L 9/06* (2006.01)
*A46B 5/00* (2006.01)
(Continued)

(52) U.S. Cl.
CPC ..... *A47L 9/0673* (2013.01); *A46B 5/0095* (2013.01); *A46B 9/005* (2013.01);
(Continued)

(58) Field of Classification Search
CPC ..... A47L 9/06; A47L 11/4044; A47L 13/12; A47L 11/00
See application file for complete search history.

(56) References Cited

U.S. PATENT DOCUMENTS 2,641,787 A * 6/1953 Vosbikian ..... A47L 13/12 15/116.2
3,821,831 A * 7/1974 Grover ..... A47L 9/0653 15/373
(Continued)

FOREIGN PATENT DOCUMENTS

CN 202477595 U 10/2012
CN 204950812 U * 1/2016 ..... A47L 9/0477
(Continued)

OTHER PUBLICATIONS

International Search Report and Written Opinion for Application No. PCT/GB2020/053308 dated Mar. 2, 2021 (9 pages).
(Continued)

*Primary Examiner* — Michael D Jennings
(74) *Attorney, Agent, or Firm* — Michael Best & Friedrich LLP

(57) ABSTRACT

A cleaner head for a cleaning appliance including a housing having a front side, a rear side, and first and second sides which extend between the front side and the rear side, the housing further including a floor facing surface which extends between the front side, rear side and first and second sides which, in use, faces a surface to be cleaned. A floor engaging device is connected to the floor facing surface of the housing and which extends laterally between the first and second sides of the housing, said floor engaging device including a first portion for absorbing liquid from a surface to be cleaned; and a second portion positioned closer to
(Continued)

either a front side or a rear side of the housing, said second portion being relatively stiff compared to the first portion.

21 Claims, 10 Drawing Sheets

(51) Int. Cl.

| | |
|---|---|
| ***A46B 9/00*** | (2006.01) |
| ***A46B 9/06*** | (2006.01) |
| ***A46D 1/00*** | (2006.01) |
| ***A47L 7/00*** | (2006.01) |
| ***A47L 9/00*** | (2006.01) |
| ***A47L 9/04*** | (2006.01) |
| *A47L 11/40* | (2006.01) |

(52) U.S. Cl.
CPC ..... *A46B 9/06* (2013.01); *A46D 1/0207* (2013.01); *A47L 7/0009* (2013.01); *A47L 9/009* (2013.01); *A47L 9/0477* (2013.01); *A47L 9/0488* (2013.01); *A46B 2200/3033* (2013.01); *A47L 11/40* (2013.01)

(56) References Cited

U.S. PATENT DOCUMENTS

| | | | | | |
|---|---|---|---|---|---|
| 5,027,470 | A * | 7/1991 | Takashima | A47L 5/30 | 15/385 |
| 5,488,754 | A * | 2/1996 | Shadley | A47L 4/00 | 15/394 |
| 5,522,110 | A * | 6/1996 | Borofsky | A47L 13/12 | 15/115 |
| 5,722,112 | A * | 3/1998 | Scanni | A47L 5/24 | 15/373 |
| 6,029,311 | A * | 2/2000 | Scanni | A47L 9/2884 | 15/373 |
| 7,254,864 | B2 * | 8/2007 | Cipolla | A47L 7/0028 | 15/354 |
| 7,584,518 | B1 * | 9/2009 | Morad | A47L 13/12 | 15/116.2 |
| 7,636,979 | B1 * | 12/2009 | Morad | A47L 13/12 | 15/116.2 |
| 7,909,529 | B2 * | 3/2011 | Gallardo | A46B 5/02 | 401/9 |
| 2004/0134015 | A1 * | 7/2004 | Gerber | A47L 9/0673 | 15/320 |
| 2007/0074369 | A1 * | 4/2007 | Stuthers | A47L 11/4088 | 15/367 |
| 2007/0136963 | A1 * | 6/2007 | Vosbikian | A47L 13/12 | 15/49.1 |
| 2007/0169291 | A1 * | 7/2007 | Horian | A47L 13/12 | 15/118 |
| 2012/0093563 | A1 * | 4/2012 | Ganeson | A47L 13/22 | 401/25 |
| 2013/0104327 | A1 * | 5/2013 | Borofsky | A46B 5/0058 | 15/210.1 |
| 2013/0291333 | A1 * | 11/2013 | Grey | A47L 9/0411 | 15/347 |
| 2016/0150928 | A1 * | 6/2016 | Kim | A47L 9/066 | 15/418 |

FOREIGN PATENT DOCUMENTS

| | | | |
|---|---|---|---|
| EP | 0405819 | A2 | 1/1991 |
| JP | 2004222961 | A | 8/2004 |
| WO | 9625872 | A1 | 8/1996 |

OTHER PUBLICATIONS

Search Report issued by the United Kingdom Intellectual Property Office for Application No. 1918988.5 dated Jun. 18, 2020 (1 page).

* cited by examiner

CLEANER HEAD FOR A CLEANING APPLIANCE

CROSS-REFERENCE TO RELATED APPLICATIONS

This application is a U.S. national phase application of International Patent Application No. PCT/GB2020/053308, filed Dec. 18, 2020, which claims priority to UK Patent Application No. 1918988.5, filed Dec. 20, 2019, the entire contents all of which are hereby incorporated by reference herein.

FIELD OF THE INVENTION

The present invention relates to a cleaner head for a cleaning appliance. In particular, but not exclusively, the invention relates to a cleaner head for a multi-floor, or wet/dry, vacuum cleaner.

SUMMARY

According to a first aspect of the invention we provide a cleaner head for a cleaning appliance, including:

- a housing having a front side, a rear side, and first and second sides which extend between the front side and the rear side, the housing further including a floor facing surface which extends between the front side, rear side and first and second sides which, in use, faces a surface to be cleaned; and a floor engaging device which is connected to the floor facing surface of the housing and which extends laterally between the first and second sides of the housing, said floor engaging device including:
- a first portion for absorbing liquid from a surface to be cleaned; and
- a second portion positioned closer to either a front side or a rear side of the housing, said second portion being relatively stiff compared to the first portion.

The floor engaging device may include a third portion positioned to the side generally opposite the second portion, e.g. the rear side or front side. The third portion may be relatively stiff compared to the first portion.

The second portion may include a plurality of bristles for guiding liquid from a surface to be cleaned towards the first portion.

The plurality of bristles may be arranged in tufts.

The first portion may have a free end. The second portion may have a free end. The free end of the second portion may be positioned further away from the floor facing surface of the housing than the free end of the first portion.

The first portion may include first and second lateral ends. The second portion may include first and second lateral ends. The first and second lateral ends of the second portion are the same, or substantially the same, distance from the first and second sides of the housing as the first and second lateral ends of the first portion.

The first portion may include first and second lateral ends. The second portion may include first and second lateral ends. The first and second lateral ends of the second portion may be closer, respectively, to the first and second sides of the housing that the first and second lateral ends of the first portion.

The first portion may have a length between its first and second lateral ends. The second portion may have a length between its first and second lateral ends. The first and second portions may be at least partially in contact along their respective lengths.

The second portion may be positioned adjacent, preferably directly adjacent, the first portion.

The second portion may be formed from a plastics material.

The third portion may include one or more or all of the features of the second portion as set forth above in respect of the first aspect of the invention.

The third portion may be substantially the same as the second portion.

The first portion may include a microfibre material.

The first portion may include a felt material.

According to a second aspect of the invention we provide a cleaning appliance including a cleaner head according to the first aspect of the invention.

The cleaning appliance may include a source of suction and a dust collection container.

BRIEF DESCRIPTION OF THE DRAWINGS

Embodiments of the invention will now be described, by way of example only, with reference to the accompanying drawings, of which.

DETAILED DESCRIPTION

Figure 1:
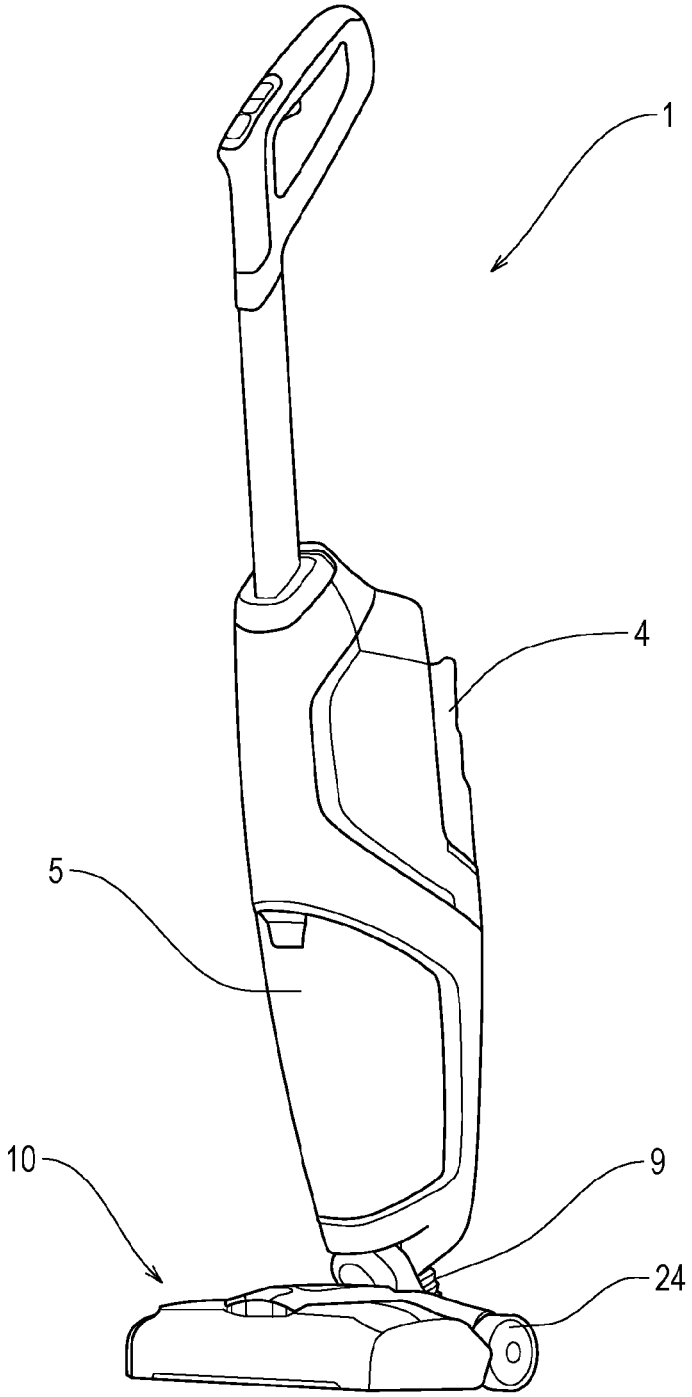
FIG. 1 is a perspective view of a vacuum cleaner in accordance with an embodiment of the invention.
Figure 2:
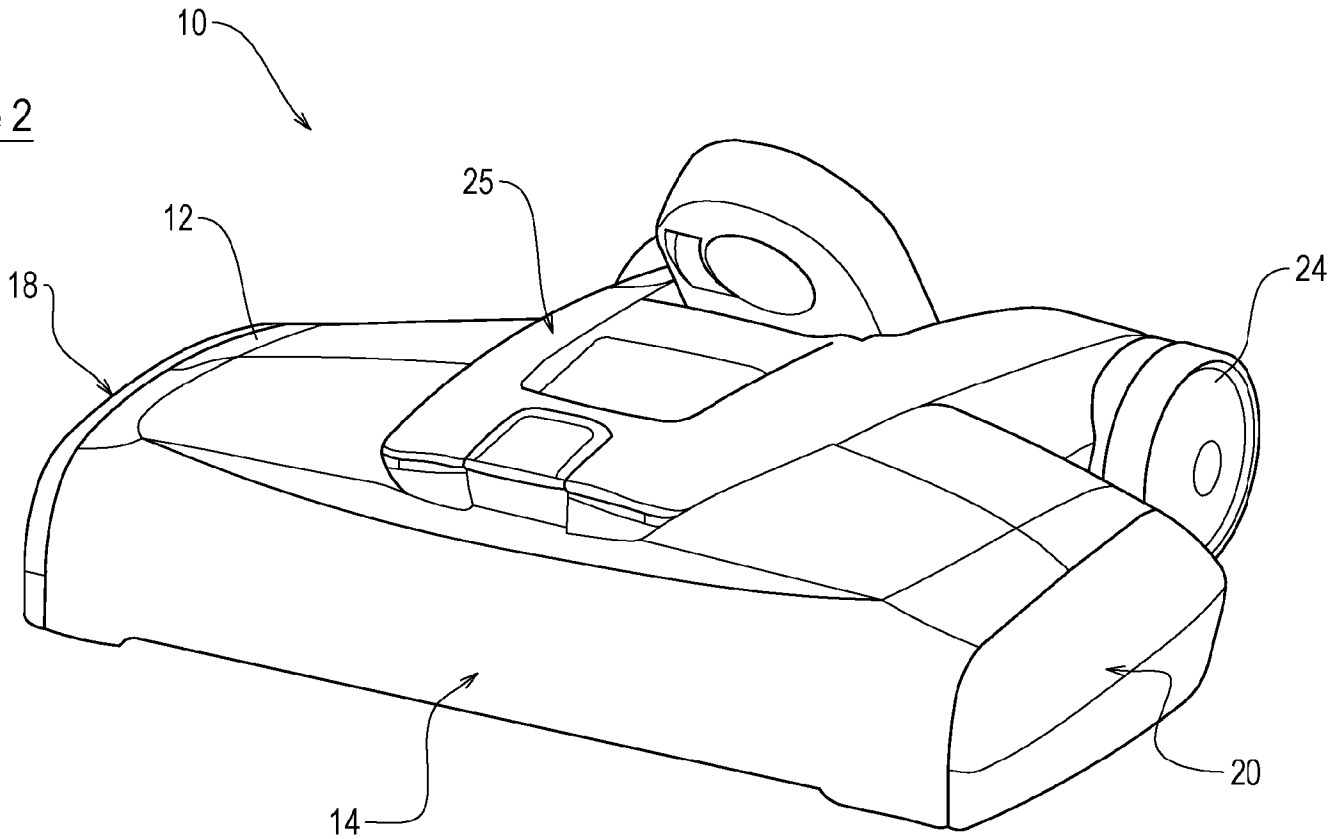
FIG. 2 is a perspective view of a cleaner head in accordance with an embodiment of the invention (outlet pipe 9 not shown)
Figure 3:
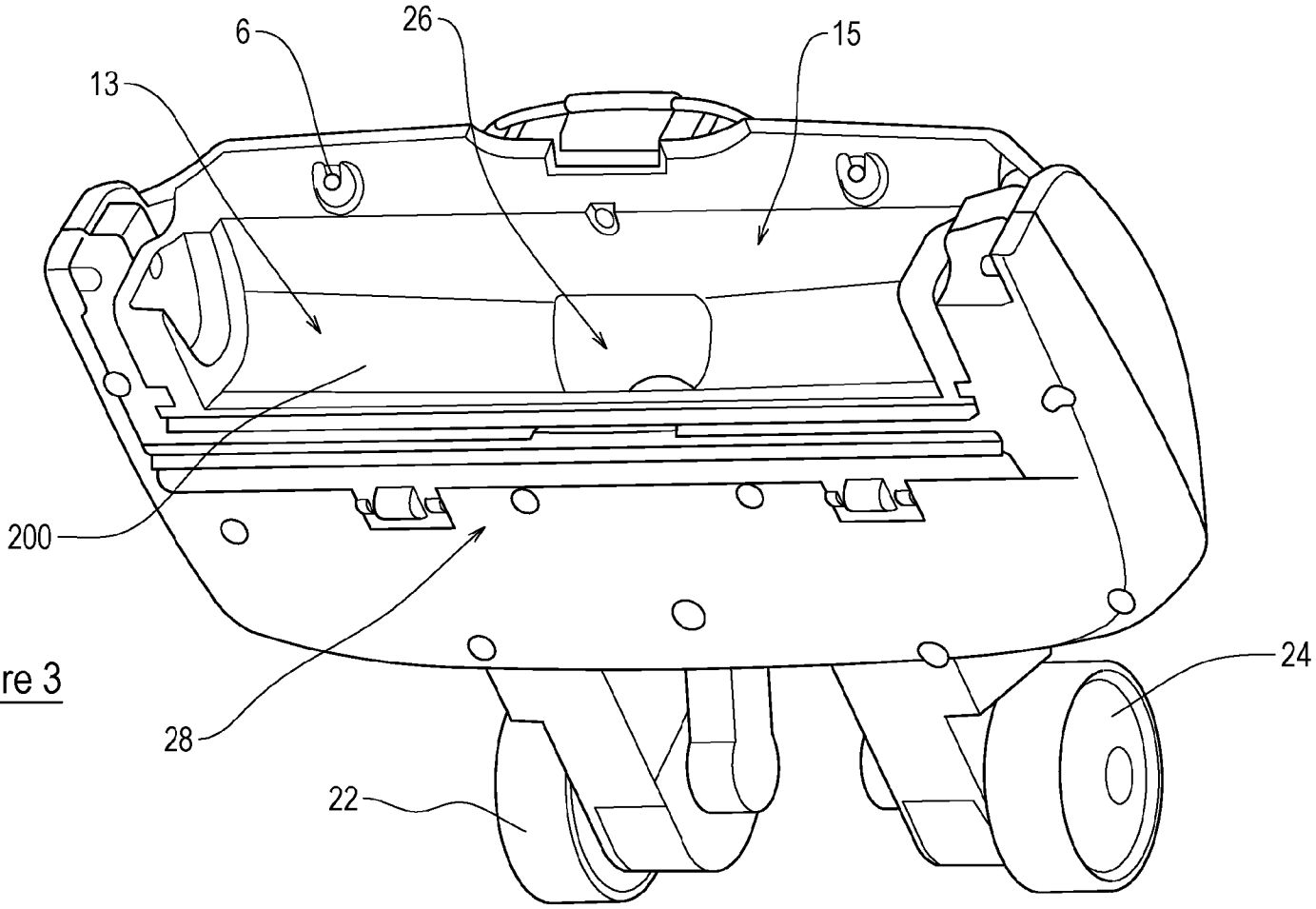
FIG. 3 is a further perspective view of the cleaner head of FIG. 2 with a cover and agitator of the cleaner head removed (outlet pipe 9 not shown)

Referring to FIG. 1 there is shown a surface cleaning appliance 1 according to an embodiment of the invention. The surface cleaning appliance 1 is, in embodiments a wet/dry vacuum cleaner, or multi-floor, cleaner. The surface cleaning appliance 1 includes a main body 2 and a cleaner head 10. The surface cleaning appliance 1 may rest on the cleaner head 10 in use and/or when in a stored position. The main body 2 may be connected to the cleaner 10. In embodiments the main body 2 may be pivotably connected to the cleaner head 10. The connection between the main body 2 and the cleaner head 10 may permit the main body to pivot in a fore-aft direction in which the cleaner is moved during use and to respective left and right sides of the cleaner head 10 which are generally perpendicular, or perpendicular, to the fore-aft direction in which the cleaner is moved during use. In embodiments the pivotal connection may permit the main body 2 to sit within a periphery of the cleaner head 10, i.e. within front, rear and first and second sides of the cleaner head 10 (described in more detail below), so that a centre of gravity of the surface cleaning appliance 1 is positioned within a footprint of the cleaner head 10. This permits the surface cleaning appliance to be stored in an upright position. To permit this pivotal connection an outlet pipe 9 is provided between the cleaner head 10 and the main body 2. The outlet pipe 9 is relatively flexible and ensures that the pivotal connection between the main body 2 and cleaner 10 can function. The outlet pipe 9 is fluidly connected to a dirty air outlet of the cleaner head and to a dirt collection container 5. This is described in more detail below.

It should be appreciated that in other embodiments the main body 2 may be fixed in position with respect to the cleaner head 10. In further envisaged embodiments the surface cleaning appliance 1 may be a cylinder style cleaner. In such embodiments the surface cleaning appliance may include a wand, a first end of which is connected to the outlet pipe 9 and a second end of which is connected to the cleaner head 10.

The surface cleaning appliance includes a handle 3 for a user to grasp. The handle 3 may be positioned above the main body 2. In embodiments the handle 3 may be positioned at a top of the surface cleaning appliance 1.

The main body 2 houses a source of suction, e.g. a motor, fan, impeller, for creating a vacuum (not shown). In some embodiments the motor may be a brushless motor. The source of suction may be positioned at a top of the main body 2. In embodiments, the source of suction may be positioned adjacent the handle 3.

A cleaning fluid supply tank 4 for holding a cleaning fluid is supported on the main body 2. In use, the cleaning fluid supply tank 4 receives fluid for cleaning a surface to be cleaned. For example, the cleaning fluid supply tank may receive a pre-mixed cleaning solution for cleaning a surface. In other embodiments the cleaning fluid supply tank 4 may receive water to which a concentrated cleaning solution is added, either in the cleaning fluid supply tank or subsequently from a further cleaning fluid supply tank (not shown) of the cleaning appliance 1. The cleaning fluid supply tank 4 is releasably connectable to the main body 2, although it could be fixed in the main body 2. In embodiments, the cleaning fluid supply tank 4 is received, at least partially, within a recess on an exterior surface of the main body 2. A fluid inlet (not shown) is provided in the recess to which the cleaning fluid supply tank 4 is fluidly connectable. The cleaning fluid supply tank 4 is positioned on a rear of the main body 2 with respect to a fore-aft direction in which the cleaner is moved during use. The cleaning fluid supply tank 4 is also positioned close to, or adjacent, the source of suction.

The fluid inlet is fluidly connected to a cleaning fluid dispensing device 6 on the cleaner head 10. In embodiments the cleaning fluid dispensing device is at least one spray nozzle 6. The at least one spray nozzle 6 sprays cleaning fluid onto an agitator of the cleaner head 10. The at least one spray nozzle may alternatively, or additionally, spray cleaning fluid onto a surface to be cleaned. The cleaning fluid dispensing device is fluidly connected to the fluid inlet via fluid channels which extend from and through the main body 2 to the cleaner head 10. This permits fluid from the cleaning fluid supply tank 4 to be conveyed to the cleaning fluid dispending device 6.

The main body 2 also supports a dirt collection container 5 which is fluidly connected to the source of suction. The dirt collection container 5 is also fluidly connected to the dirty air outlet of the cleaner head by the outlet pipe 9. The dirt collection container may include an air/liquid separator to separate any dirty cleaning fluid, and dirt entrained therein, which has been suctioned from the surface to be cleaned from the air. The dirt collection container 5 is releasably connectable to the main body 2 of the cleaning appliance 1, although it could be fixed in the body 2. The dirt collection container is also provided in a lower half of the main body 2, closer to the cleaner head 10 than the handle 3. The dirt collection container 5 is provided on a front of the main body with respect to a fore-aft direction in which the cleaner is moved during use. The dirt collection container 5 may support a bag or other receptacle for holding collected dirt, with the bag or other receptacle being removable for discarding the collected dirt.

The cleaner head 10 is described in more detail below with reference to FIGS. 2 to 10.

Figure 4:
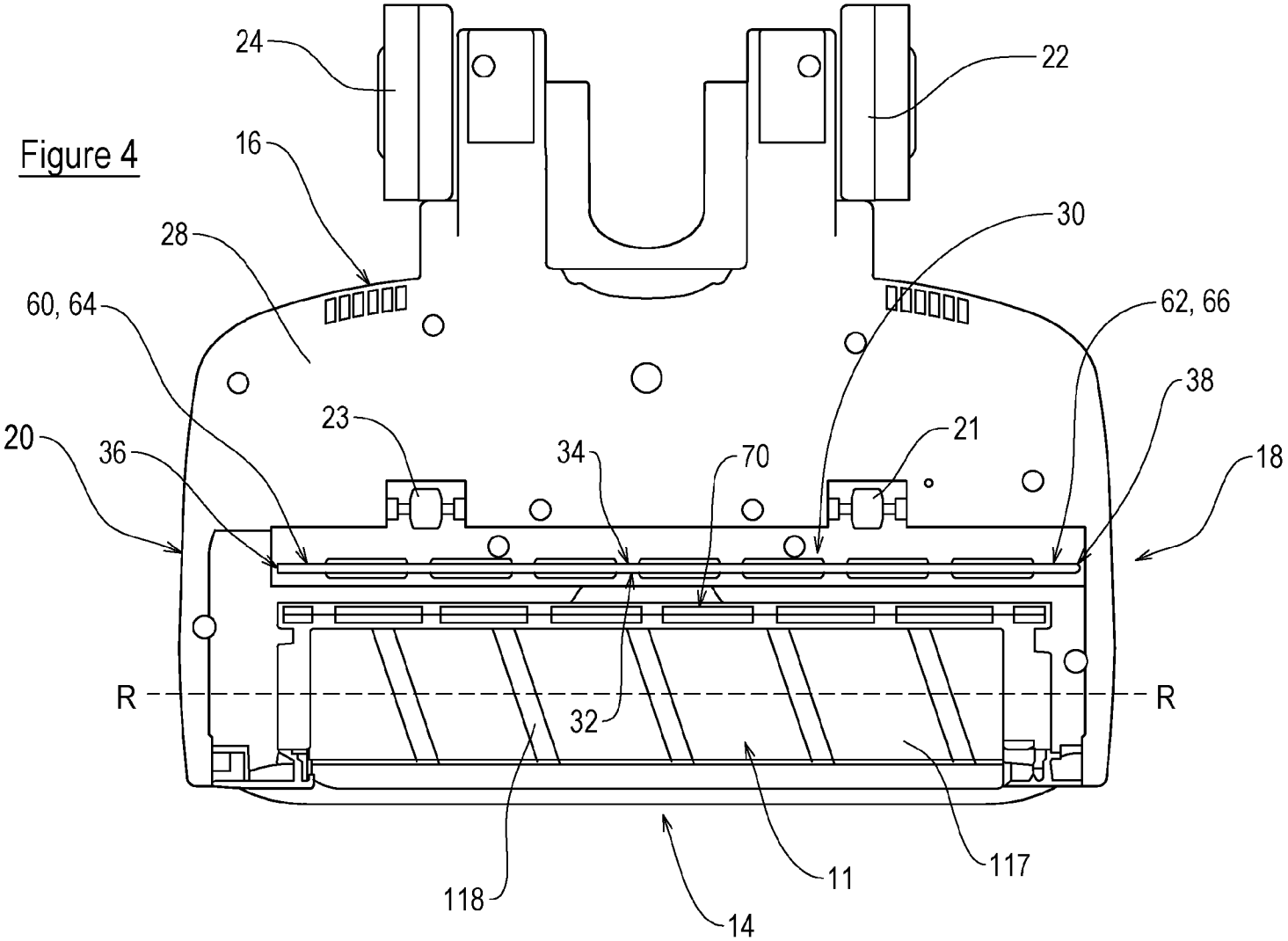
FIG. 4 is a bottom view of the cleaner head of FIG. 2 (outlet pipe 9 not shown)
Figure 5:
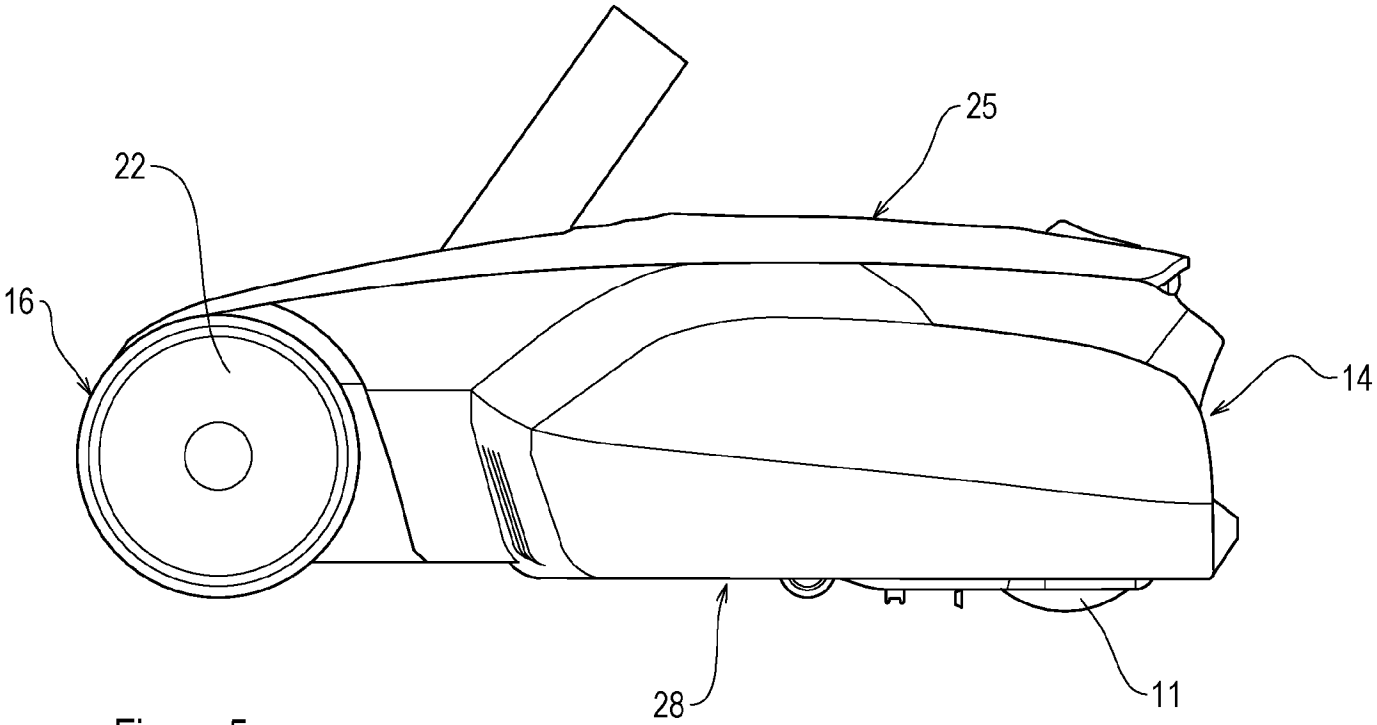
FIG. 5 is a side view of the cleaner head of FIG. 2 (outlet pipe 9 not shown)
Figure 6:
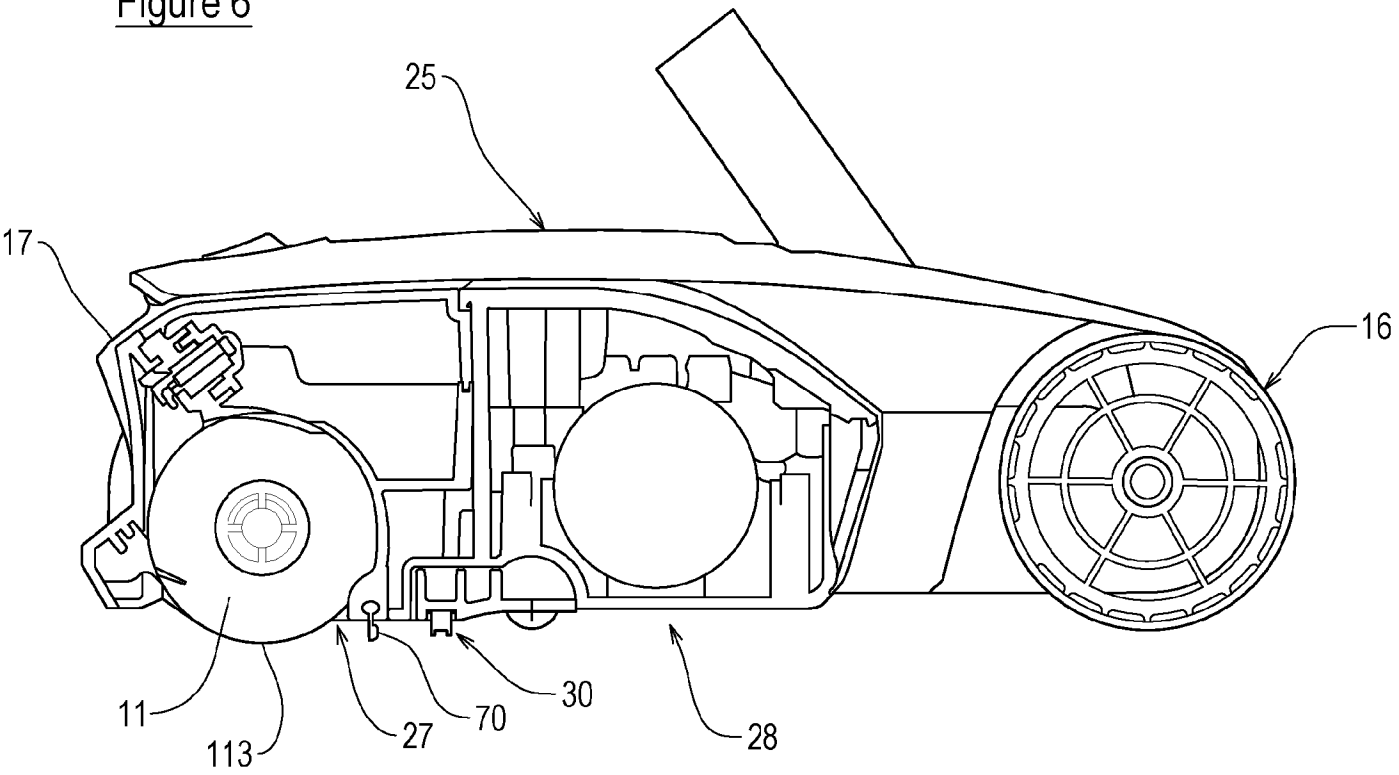
FIG. 6 is a cross-sectional side view of the cleaner head of FIG. 2 (outlet pipe 9 not shown)
Figure 7:
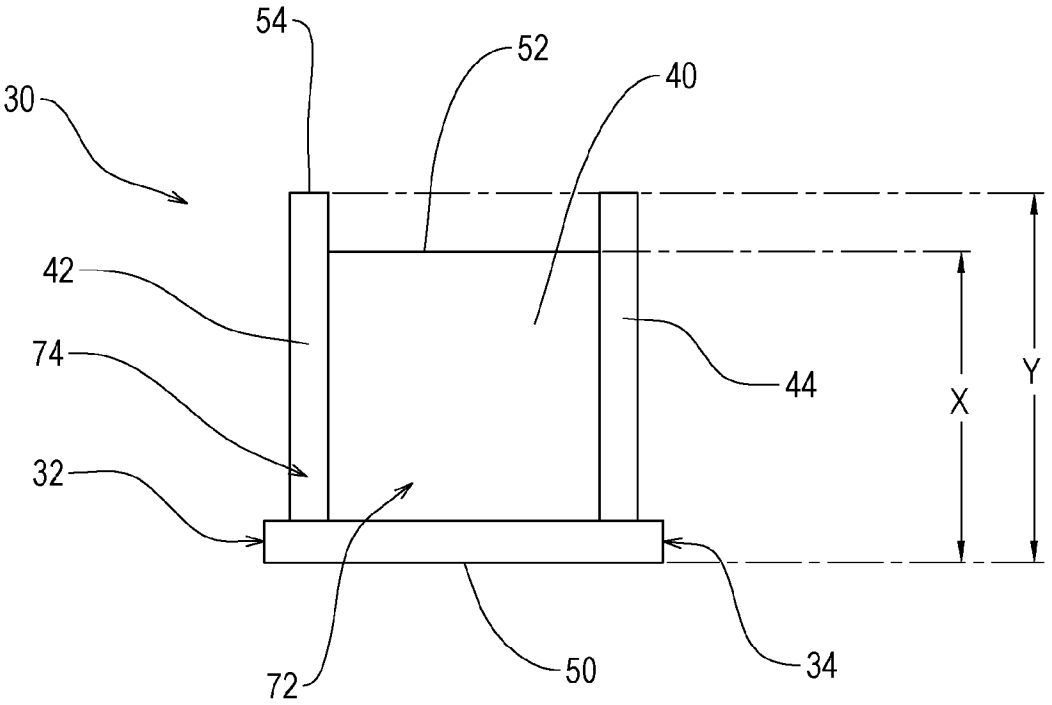
FIG. 7 is an enlarged schematic cross-sectional side view of a floor engaging device viewed in a direction along the axis R of the agitator 11.
Figure 8:
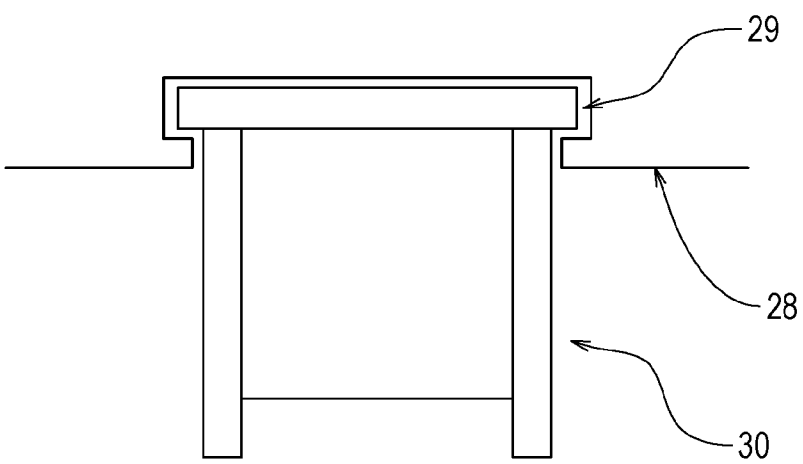
FIG. 8 is an enlarged schematic cross-sectional side view of the floor engaging device of FIG. 7 viewed in a direction along the axis R of the agitator 11 when connected to a floor facing surface 28 of the housing 12.
Figure 9:
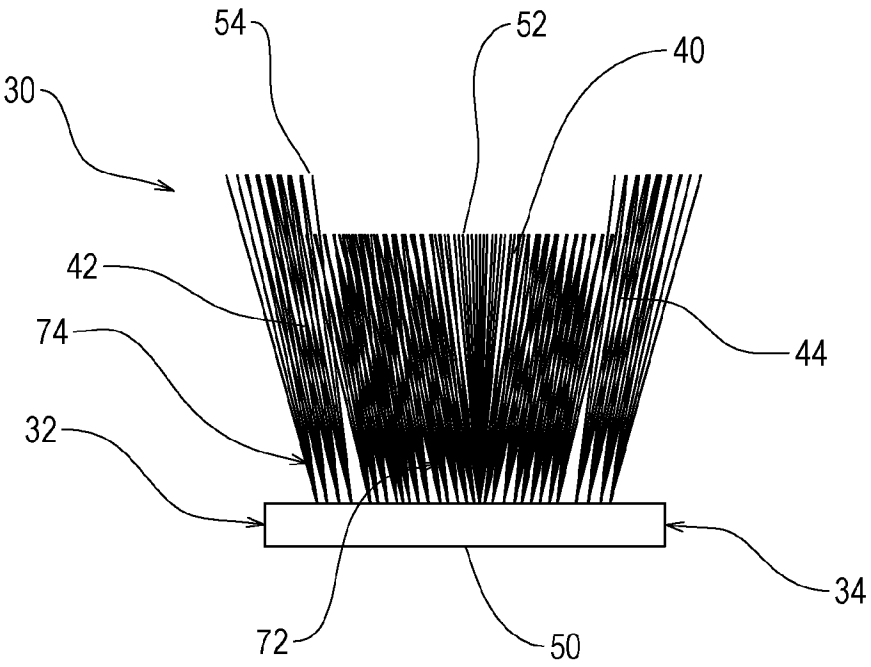
FIG. 9 is a further enlarged schematic cross-sectional side view of a floor engaging device viewed in a direction along the axis R of the agitator 11.
Figure 10:
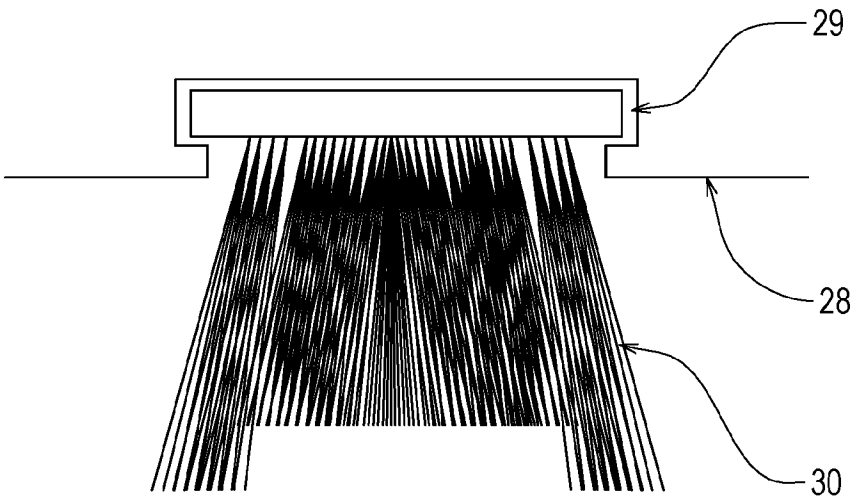
FIG. 10 is an enlarged schematic cross-sectional side view of the floor engaging device of FIG. 9 viewed in a direction along the axis R of the agitator 11 when connected to a floor facing surface 28 of the housing 12.

In the present embodiment the cleaner head 10 includes wheels 22, 24 which are positioned at a rear side 16 of the cleaner head 10. In embodiments, the wheels 22, 24 are positioned either side of the outlet pipe 9 which fluidly connects a dirty air outlet 26 of the cleaner head 10 to the dirt collection container 5. As can be seen in FIG. 4, further wheels 21, 23 are provided on a floor facing surface of the cleaner head 10. The wheels 22, 24 and further wheels 21, 23 permit the surface cleaning appliance 1 to move across a surface to be cleaned. In other embodiments the cleaner head 10 may be provided with a roller instead of, or in addition to, the wheels 22, 24 positioned at the rear side 16 of the cleaner head 10.

The cleaner head 10 includes a housing 12 which is movable along a surface to be cleaned. The housing 12 also includes a front side 14 and first and second sides, e.g. left and right sides, 18, 20 which extend between the front side 14 and the rear side 16. The front side 14, rear side 16, and first and second sides 18, 20 define a periphery which defines a footprint of the cleaner head 10. The housing 12 includes a floor facing surface 28 which is described in more detail below.

The housing 12 includes a top surface 25. The top surface 25 extends between the front side 14, rear side 16 and first and second sides 18, 20. In use, the top surface 25 faces away from a surface to be cleaned.

The cleaner head 10 also includes an agitator 11 rotatable about an axis R within a chamber 13 at least partially defined by the housing 12. The axis R is generally parallel to a surface to be cleaned and orthogonal to a fore-aft direction in which the cleaner is moved during use. The agitator 11 is formed as a generally cylindrical member with a microfibre material 117 on its outer surface 113. The microfibre material 117 may be tufted. Bristles 118 may be interspersed with the microfibre material. The bristles 118 may be provided in tufts in a helical pattern on the outer surface of the agitator 11.

The floor facing surface 28 extends between the front side 14, rear side 16 and first and second sides 18, 20. In use the floor facing surface 28 faces a surface to be cleaned. The floor facing surface 28 includes a floor engaging device 30 and a wiper device 70. The floor engaging device 30 is positioned rearwardly of the wiper device 70. The floor facing surface 28 includes a dirty air inlet 27 through which dirt entrained air and dirty cleaning fluid may be received by the cleaner head 10. The dirty air inlet 27 extends between a portion of the agitator which contacts the surface to be cleaned in use and the wiper device 70.

The chamber 13 at least partially surrounds the agitator 11. The chamber 13 is at least partially defined by a rear chamber wall 200. The rear chamber wall 200 defines the dirty air outlet 26. The dirty air outlet 26 is fluidly connected to the chamber 13. The chamber 13 is also fluidly connected to the dirty air inlet 27 which faces the surface to be cleaned.

A floor engaging device 30 is connected to the floor facing surface 28 of the housing 12 and extends laterally between (but not all the way to each respective side, although they could) the first and second sides 18, 20 of the housing 12 for wiping, or engaging, a surface to be cleaned. In embodiments the floor engaging device 30 extends generally linearly between the first and second sides 18, 20 of the housing 12. The floor engaging device 30 is positioned between the dirty air inlet 27 and the rear side 16 of the housing 12. In other words, the floor engaging device 30 is positioned rearwardly of the dirty air inlet 27. A further wiper device, in this example a squeegee, 70 is positioned between the dirty air inlet 27 and the floor engaging device 30.

The floor engaging device 30 includes a first portion 40 for absorbing liquid from a surface to be cleaned. The first portion 40 includes first and second lateral ends 64, 66. The first portion 40 has a length between the first and second lateral ends 64, 66. The first portion 40 extends generally linearly between the first and second sides 18, 20 of the housing 12. In embodiments, the first portion 40 extends generally parallel to the axis R of the agitator 11.

In the present embodiment the first portion is formed from felt, for example similar to that on a lint pick-up strip for a vacuum cleaner head without a rotatable agitator. The felt could be formed from a natural or synthetic fibre. In embodiments the first portion 40 may be include one or more or all of the following materials: microfibre; open cell foam; flannel; chamois; cloth; cotton; polyester; polyethylene; nylon; or acrylic. However, other absorbent materials could be used without departing from the scope of the present invention.

The cross-sectional shape/silhouette of the first portion 40 when viewed in a direction perpendicular, or generally perpendicular, to an axis R of the agitator 11, remains substantially the same along its length. The first portion 40 may be generally trapezoidal (see examples in FIGS. 9 and 10 where the configuration of its bristles or tufts creates that general shape) in side cross-sectional view perpendicular, or generally perpendicular, to an axis R of the agitator 11. However, in other embodiments (see FIGS. 7 and 8) the first portion 40 may be generally square, rectangular, triangular or circular, or any other polygonal shape, in side cross-sectional view perpendicular, or generally perpendicular, to an axis R of the agitator 11.

In each example, the first portion 40 has a free end 52 and a proximal end 72 which lies closer to the floor facing surface 28. The free end 52 of the first portion 40 may be positioned at a distance X away from a base 50 of the floor engaging device 30 of between 2.00 to 6.00 mm; preferably 2.50 to 5.00 mm; even more preferably 3.00 to 4.00 mm; and most preferably 3.80 mm. The base 50 of the floor engaging device 30 is described in more detail below.

The floor engaging device 30 includes a second portion 42. The second portion 42 includes first and second lateral ends 60, 62. The second portion has a length between the first and second lateral ends 60, 62. The second portion 42 also extends generally linearly between the first and second sides 18, 20 of the housing 12. In embodiments the second portion 42 extends generally parallel to the axis R of the agitator 11. The second portion 42 is positioned closer to the front side 14 of the housing 12 than the first portion 40. In embodiments, the second portion 42 is positioned adjacent, preferably directly adjacent, the first portion 40, such that it abuts the first portion 40.

The cross-sectional shape/silhouette of the second portion 42 when viewed in a direction perpendicular, or generally perpendicular, to an axis R of the agitator 11, remains substantially the same along its length. In the example shown in FIGS. 9 and 10 the second portion 42 is generally trapezoidal in side cross-sectional view (where the configuration of its bristles or tufts creates that general shape). However, in other embodiments the second portion 42 may be generally square, rectangular (see FIGS. 7 and 8), triangular or circular, or any other polygonal shape, in side cross-sectional view perpendicular, or generally perpendicular, to an axis R of the agitator 11.

The second portion 42 also has a free end 54 and a proximal end 74 which lies closer to the floor facing surface 28. The free end 54 of the second portion 42 may be positioned at a distance Y away from the base 50 of the floor engaging device 30 of between 2.00 to 6.00 mm; preferably 2.50 to 5.50 mm; even more preferably 3.00 to 5.00 mm; and most preferably 4.50 mm.

The second portion 42 is relatively stiff compared to the first portion 40. The second portion 42 includes a plurality of bristles 43 for guiding liquid from a surface to be cleaned towards the first portion 40. The bristles 43 may be arranged in tufts which extend between the first and second sides 18, 20 of the housing 12.

The bristles of the second portion 42 are formed of plastic in the present embodiment. The plastic may include a thermoplastic elastomer and/or PVC. In embodiments, the bristles may be formed of one or more or all of the following materials: PVC; polyethylene; nylon; ABS; or rubber.

The first and second portions 40, 42 may be at least partially in contact along their respective lengths. This is particularly the case where the first and second portions 40, 42 are formed of bristles or tufts.

In embodiments the proximal end 74 of the second portion 42 is at least partially in contact with the proximal end 72 of the first portion 40. The proximal end 74 of the second portion 42 and the proximal end 72 of the first portion 40 are permanently connected to the base 50 of the floor engaging device 30.

The floor engaging device includes a third portion 44. The third portion 44 is positioned closer to the rear side 16 of the housing 12 than the first portion 40. In other words, the third portion 44 is positioned further from the agitator 11 than the first and second portions 40, 42. In embodiments, the third portion 44 is positioned adjacent, preferably directly adjacent, the first portion 40, such that it abuts the first portion 40. The third portion 44 is substantially the same as, e.g. is a mirror image of, or is identical to, the second portion 42, but it need not be.

As mentioned above, the floor engaging device 30 includes a base 50 for permitting the floor engaging device 30 to be connected to the floor facing surface 28. The base 50 includes a pair of formations 32, 34 for permitting connection of the floor engaging device 30 to the floor facing surface 28. The formations 32, 34 are extensions to or from the base 50 which extend forwardly and rearwardly, respectively, in a plane substantially parallel to the surface 28.

These formations 32, 34, in hand with the first, second and third portions 40, 42, 44 give the device 30 a T-shape form in side view.

In embodiments, the floor facing surface 28 of the housing 12 includes a floor engaging device holding portion 29 to hold the floor engaging device 30 in position. In embodiments the floor engaging device holding portion 29 is a recess 29 formed in the floor facing surface 28 in which the at least one formation 32, 34 is received. In embodiments the floor engaging device 30 is connected to the floor facing surface by sliding the at least one formation 32, 34 of the base 50 into the recess 29 from the first side 18 of the housing 12 towards the second side 20 of the housing 12. However, it should be appreciated that other types of holding portion 29 could be utilised. For example, hook and loop formations, or hook and hook formations could be used to releasably connect the floor engaging device 30 to the floor facing surface 28 without departing from the scope of the present invention.

The free end 54 of the second portion 42 is positioned further away from the floor facing surface 28 of the housing 12 than the free end 52 of the first portion 40. In other words, the free end 54 of the second portion 42 is positioned closer to a surface to be cleaned than the free end 52 of the first portion 40. However, in other envisaged embodiments the free end 52 of the first portion 40 may be positioned further away from the floor facing surface 28 of the housing 12 than the free end 54 of the second portion 42. In other words, in other envisaged embodiments the free end 52 of the first portion 40 may be positioned closer to a surface to be cleaned than the free end 54 of the second portion 42.

In the present embodiment first and second ends 60, 62 of the second portion 42 extend towards the respective first and second sides 18, 20 of the housing 12 to the same extent as first and second ends 64, 66 of the first portion 40. In other words, the first and second ends 60, 62 of the second portion 42 are in alignment with the first and second ends 64, 66 of the first portion 40 along planes which extend generally orthogonally to a main axis of the floor engaging device 30. However, in other embodiment the second portion 42 may extend closer to the first and/or second sides 18, 20 of the housing than the first portion 40. In embodiments the first and/or second portions 40, 42 may extend laterally across the floor facing surface 28 of the housing 12 between the first and second sides 18, 20 of the housing 12 a distance of at least: 200.00 mm; 210.00 mm; 220.00 mm; 230.00 mm; 240.00 mm; or 250.00 mm; and at most 300.00 mm; 290.00 mm; 280.00 mm; 270.00 mm; 260.00 mm; or 250.00 mm. In the present embodiment the first and second portions 40, 42 extend laterally across the floor facing surface 28 of the housing 12 between the first and second sides 18, 20 of the housing 12 a distance of 248.30 mm.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although certain example embodiments of the invention have been described, the scope of the appended claims is not intended to be limited solely to these embodiments. The claims are to be construed literally, purposively, and/or to encompass equivalents.

The invention claimed is:

1. A cleaner head for a cleaning appliance comprising:

a housing having a front side, a rear side, and first and second sides which extend between the front side and the rear side, the housing further including a floor facing surface which extends between the front side, rear side and first and second sides which, in use, faces a surface to be cleaned;

an agitator rotatable about an axis; and a floor engaging device which is connected to the floor facing surface of the housing such that the floor engaging device is fixed from rotation relative to the housing and the floor engaging device extends laterally between the first and second sides of the housing, the agitator spaced from the floor engaging device and the agitator rotatable relative to the floor engaging device, said floor engaging device including:

a first portion for absorbing liquid from a surface to be cleaned; and a second portion positioned closer to either the front side or the rear side of the housing, said second portion being stiffer than the first portion.

2. The cleaner head according to claim 1 wherein the floor engaging device includes a third portion positioned to the side generally opposite the second portion, said third portion being relatively stiff compared to the first portion.

3. The cleaner head according to claim 2 wherein the third portion is substantially the same as the second portion.

4. The cleaner head according to claim 1 wherein the second portion includes a plurality of bristles for guiding liquid from a surface to be cleaned towards the first portion.

5. The cleaner head according to claim 4 wherein the plurality of bristles are arranged in tufts.

6. The cleaner head according to claim 1 wherein the first portion has a free end; and wherein the second portion has a free end;

wherein the free end of the second portion is positioned further away from the floor facing surface of the housing than the free end of the first portion.

7. The cleaner head according to claim 1 wherein the first portion includes first and second lateral ends, and wherein the second portion includes first and second lateral ends, and wherein the first and second lateral ends of the second portion are substantially the same distance from the first and second sides of the housing as the first and second lateral ends of the first portion.

8. The cleaner head according to claim 7 wherein the first portion has a length between its first and second lateral ends, and wherein the second portion has a length between its first and second lateral ends, and wherein the first and second portions are at least partially in contact along their respective lengths.

9. The cleaner head according to claim 1 wherein the first portion includes first and second lateral ends, and wherein the second portion includes first and second lateral ends, and wherein the first and second lateral ends of the second portion are closer, respectively, to the first and second sides of the housing than the first and second lateral ends of the first portion.

10. The cleaner head according to claim 1 wherein the second portion is positioned directly adjacent the first portion.

11. The cleaner head according to claim 1 wherein the second portion is formed from a plastics material.

12. The cleaner head according to claim 1 wherein the first portion includes a microfibre material.

13. The cleaner head according to claim 1 wherein the first portion includes a felt material.

14. The cleaner head according to claim 1 wherein the floor facing surface includes a dirty air inlet.

15. The cleaner head according to claim 14 wherein the floor engaging device is positioned rearwardly of the dirty air inlet, and wherein the agitator is positioned forwardly of the dirty air inlet.

16. The cleaner head according to claim 15 wherein the floor engaging device is positioned between the dirty air inlet and the rear side of the housing.

17. The cleaner head according to claim 1 wherein wheels are positioned at the rear side of the cleaner head.

18. The cleaner head according to claim 1 wherein the first portion extends generally parallel to the axis of the agitator.

19. The cleaner head according to claim 1 wherein the floor engaging device is held in a recess formed in the floor facing surface and is slidably removable therefrom.

20. The cleaning appliance including a cleaner head according to claim 1.

21. The cleaning appliance according to claim 20 wherein the cleaning appliance includes a source of suction and a dust collection container.

* * * * *